US005576718A

United States Patent [19]

Buralli et al.

[11] Patent Number: 5,576,718

[45] Date of Patent: Nov. 19, 1996

[54] THIN BROADBAND MICROSTRIP ARRAY ANTENNA HAVING ACTIVE AND PARASITIC PATCHES

[75] Inventors: Bernard Buralli, Cannes-La-Bocca; Marc Monaco, Nice; Jean-Pierre Boisset, Mougins, all of France

[73] Assignee: Aerospatiale Societe Nationale Industrielle, France

[21] Appl. No.: 596,929

[22] Filed: Feb. 5, 1996

Related U.S. Application Data

[63] Continuation of Ser. No. 57,727, May 5, 1993, abandoned.

[30] Foreign Application Priority Data

May 5, 1992 [FR] France ..... 92 05509

[51] Int. Cl.[6] ..... H01Q 1/38

[52] U.S. Cl. ..... 343/700 MS

[58] Field of Search ..... 343/700 MS; H01Q 1/38

[56] References Cited

U.S. PATENT DOCUMENTS

| | | | |
|---|---|---|---|
| 4,118,706 | 10/1978 | Kerr | 343/700 MS |
| 4,180,817 | 12/1979 | Sanford | 343/700 MS |
| 4,370,657 | 1/1983 | Kaloi | 343/700 MS |
| 4,401,988 | 8/1983 | Kaloi | 343/700 MS |
| 4,835,538 | 5/1989 | McKenna et al. | 343/700 MS |
| 4,849,765 | 7/1989 | Marko | 343/702 |
| 5,008,681 | 4/1991 | Cavallaro et al. | 343/700 MS |
| 5,220,335 | 6/1993 | Huang | 343/700 MS |

FOREIGN PATENT DOCUMENTS

| | | | |
|---|---|---|---|
| 0361417 | 4/1990 | European Pat. Off. | 343/700 MS |
| 0276903 | 11/1988 | Japan | H01Q 1/38 |
| 2067842 | 7/1981 | United Kingdom | 343/700 MS |
| 2213995 | 8/1989 | United Kingdom | H01Q 1/38 |
| 9112637 | 8/1991 | United Kingdom | 343/700 MS |
| 8907838 | 8/1989 | WIPO | H01Q 1/38 |

OTHER PUBLICATIONS

Bahl et al, *Microstrip Antennas,* 1980, pp. 56–61.

M. Haneishi et al, Shaped Beam Planar Antenna Using Microstrip Antenna With Open–Circuited Stub, Mar. 30, 1990, pp. 1–6.

*Primary Examiner*—Donald T. Hajec
*Assistant Examiner*—Steven Wigmore
*Attorney, Agent, or Firm*—Remy J. VanOphem; Thomas A. Meehan; John VanOphem

[57] ABSTRACT

An array antenna embodying on a dielectric support, a periodic succession parallel to an alignment direction of rectangular patches having alternating active patches and parasitic patches. The active patches are identical, fed with electromagnetic energy in areas such that their sides parallel to the alignment direction are radiating sides, sized to have the same resonant frequency and disposed so that their phase centers are at a distance apart less than the wavelength in air associated with the resonant frequency. The parasitic patches are separated from the active patches by slots of constant non-null width extending transversely to the alignment direction and sized to have resonant frequencies near the resonant frequency of the active patches.

21 Claims, 7 Drawing Sheets

Fig.3A
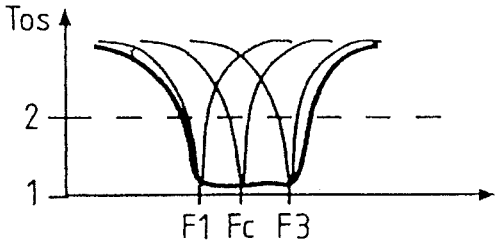
Fig.3B
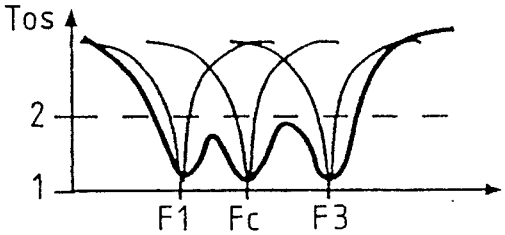
Fig.3C
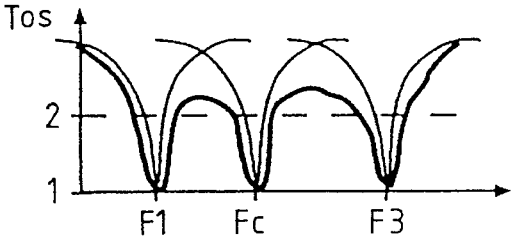
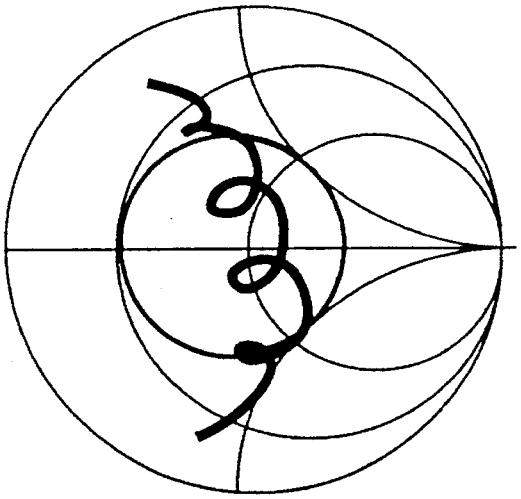
Fig.4A
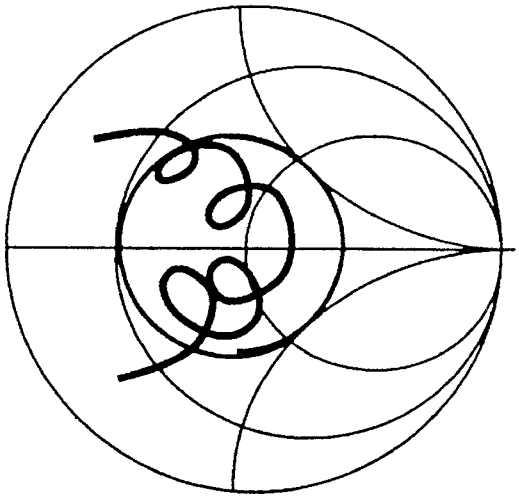
Fig.4B $\phi = 90°$ $\phi = 0°$ .2167 MHz $\phi = 90°$ $\phi = 0°$ : 2220 MHz $\phi = 90°$ $\phi = 0°$ 2332MHz $\phi = 90°$ $\phi = 0°$ 2400MHz

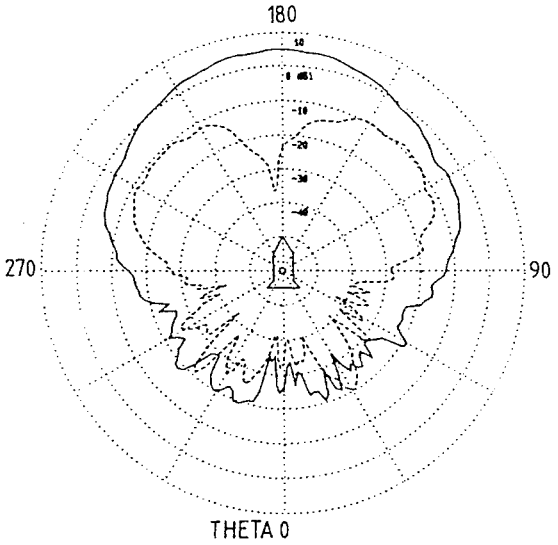
$\phi=90°$
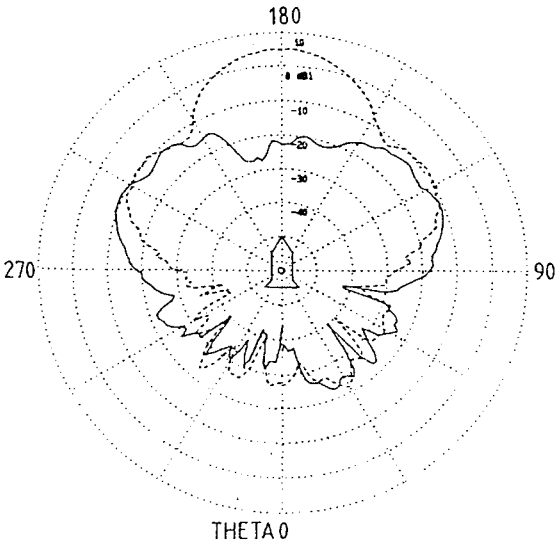
$\phi=0°$
: 2511 MHz
Fig.12B
Fig.12A

THIN BROADBAND MICROSTRIP ARRAY ANTENNA HAVING ACTIVE AND PARASITIC PATCHES

This is a continuation of application Ser. No. 08/057,727, filed May 05, 1993, now abandoned.

BACKGROUND OF THE INVENTION

1. Field of the Invention

The invention concerns a thin broadband microstrip array antenna.

The invention was made in the course of collaborative work with the electronics laboratory of the University of Nice Sophia-Antipolis, CNRS associated research team n° 1400, on which Mr MONACO worked under the supervision of Messrs CAMBIAGGIO and PAPIERNIK.

2. Description of the Prior Art

A radio frequency electromagnetic wave characterized among other things by its wavelength $\lambda$, conveying energy and usually information, can propagate in various media the most important of which are:

guided propagation media (cables, lines, waveguides, etc.); and free space propagation media (homogeneous or non-homogeneous, isotropic or non-isotropic free space, etc.).

An antenna may be regarded as an interface between these two types of media enabling partial or total transfer of electromagnetic energy from one to the other. A transmit antenna passes this energy from a guided propagation medium to a free space propagation medium and a receive antenna reverses the direction of energy transfer between the media. The following description usually refers implicitly to a transmit antenna. However, the principle of equivalence guarantees reciprocity of all stated properties with a receive antenna.

The expression antenna feed circuit(s) or device refers to all component parts of all or part of the guided propagation medium directing or collecting the electromagnetic energy to be transferred and comprising passive or active, reciprocal or non-reciprocal components.

An elementary antenna is often associated with one or more geometrical points called phase centers from which the electromagnetic wave appears to emanate for a given direction in the case of a transmit antenna.

Antenna resonance occurs at the frequency or frequencies at which the transfer of energy transmitted from the feed line to free space via the antenna is optimum; in mathematical terms, at the resonant frequency $F_r$ the complex impedance Z at the antenna input has a null imaginary part and a maximal real part.

In microwave technology it is usual to represent the locus of the impedances Z (as a function of frequency) on a SMITH chart on which each resonance appears as a loop.

Using current measuring techniques this resonance is "seen" through the matching arrangement which characterizes the transfer of energy from the feed line to the antenna. This view of the antenna behavior may be called the antenna response and is quantified in terms of return losses or the voltage standing wave ratio (VSWR) as defined below.

If Z is the impedance at the point at which matching is measured and $Z_c$ is the characteristic impedance of the feed line (according to the standard usually adopted $Z_c$=50 Ohms), then if $z=Z/Z_c$ the return loss is the complex ratio:

$$\rho=(z-1)/(z+1)$$

The VSWR is then defined as:

$$VSWR=|(1+|\rho|)/(1-|\rho|)|$$

The antenna is characterized by a number of performance indicators including:

the voltage standing wave ratio (VSWR) which allows for the quality of matching, i.e. the quantity of energy transmitted from the feed line to the antenna (the better this quality the closer the VSWR is to unity);

the radiation diagram representing the spatial distribution of the electromagnetic field E of the wave; and associated conventional parameters (gain, directivity, efficiency, −3 dB aperture, coverage probability).

The radiation diagram is conventionally represented in a frame of reference centered at a point on the antenna (its phase center if possible) and shown as "cross-sections" in a standardized system of spherical coordinates ($\theta$, $\phi$). A so-called "constant $\phi$" cross-section is the curve of variation in the field E projected onto a given polarization (either $E\theta$ or $E\phi$), $\theta$ varying from 0° to 180° (or from −180° to +180°). Likewise, a so-called "constant $\theta$" cross-section is the curve of variation in the field E projected onto a given polarization (either $E\theta$ or $E\phi$) with $\phi$ varying from 0 to 360°.

An association of elementary antennas is called an antenna array if their feed circuits have common parts or if, because of coupling between the elementary antennas, the overall radiation diagram of the array in a given frequency range depends on that of each of the antennas or radiating elements.

The array obtained by the arrangement of antennas similar to one or more elementary antennas on a given surface is often called an array antenna, usually implying a concept of geometrical repetition of the elementary antennas.

Array antennas are usually employed to obtain a radiation diagram that is highly directive in a given direction relative to the array.

The spacing $\Delta$ between the phase centers of the elementary antennas of the array divided by the wavelength $\lambda_o$ in air or in vacuum is often a critical parameter.

For example, for values of $\Delta/\lambda_o>0.5$ the occurrence of significant grating lobes outside the wanted radiation area penalizes the energy transmission balance in the free space propagation medium.

The microstrip technology entails stacking a plurality of layers of conductive or dielectric materials such as, for example, a dielectric substrate layer (glass, PTFE, for example) coated on its lower surface (or I surface) with a conductive film (copper, gold, etc.) known as the ground plane and carrying on its upper surface (or S surface) a discontinuous conductive film forming a given geometrical pattern made up of what are usually called patches.

This system can:

either guide an electromagnetic wave (microstrip line);

or radiate an electromagnetic field (microstrip antenna).

The medium in which surface currents propagate is:

either the air-substrate interface;

or the air-conductor-substrate interface.

In the former case the "effective" dielectric constant of the medium may be defined as:

$$\epsilon_e=\frac{\epsilon_r+1}{2}$$

where $\epsilon_r$ is the dielectric constant of the substrate (cf MICROSTRIP ANTENNAS by I. J. BAHL and P. BHAR-

TIA, ARTECH HOUSE, 1980).

In the second case:

$$\epsilon_e = \frac{\epsilon_r + 1}{2} + \frac{\epsilon_r - 1}{2} \frac{1}{\sqrt{\left(1 + 12\frac{h}{w}\right)}}$$

where h is the substrate thickness and w is the width of the conductor strip.

Various types of (possibly active) components or other elements may usually be provided on the S side of the structure.

By definition a microstrip antenna is a geometrically shaped element of conductive material on the S side of a dielectric layer. A rectangular or circular shape is often chosen for the following reasons:

the radiation diagram is then largely predictable; and the sizing of these elements to resonate at a given frequency is well understood.

A rectangular microstrip patch is to some extent similar to two parallel slots coincident with two radiating edges of the rectangle. The edges of a rectangular patch which must radiate (and conversely those which must not radiate) are selected by an appropriate choice of the part of the rectangle which is connected to the feed circuit. A rectangular patch is usually fed near or on the median line joining the sides to be made to radiate.

This connection may be made through the dielectric substrate or at the periphery of the patch by a microstrip line on the S side (the expression coplanar feed is sometimes used) as described in French Patent 2,226,760, among others.

It is essentially the length L of the patch between these edges which determines the antenna resonant frequency.

Appropriate equations and nomograms have been produced.

In MICROSTRIP ANTENNAS by I. J. BAHL and P. BHARTIA, ARTECH HOUSE, 1980, it is stated that to resonate at the frequency $F_r$ a rectangular patch must have a length L such that:

$$L = \frac{1}{2 \cdot \lambda_o \cdot \sqrt{(\epsilon_e)}} + 0.412 \frac{(\epsilon_e + 0.3)(W + 0.264 \cdot h)}{(\epsilon_e - 0.258)(W + 0.8 \cdot h)} \quad (1)$$

where:

$$\epsilon_e = 0.5 \cdot (\epsilon_r + 1) + 0.5 \cdot (\epsilon_r - 1)/\sqrt{(1 + 12 \cdot h/W)} \quad (2)$$

$\epsilon_e$ is the dielectric constant of the dielectric substrate, h is the height (or thickness) of the substrate, $\lambda_o$ is the wavelength in air at the frequency $F_r$ (i.e. the speed of light divided by this frequency), and W is the width of the patch, according to the above work, for example, defined by the equation:

$$W = \frac{1}{\lambda_o \sqrt{2(\epsilon_r + 1)}}$$

The choice of the width W conditions to a large degree the quality of the radiation, i.e. its efficiency and its form.

The above work also indicates that the radius R of a circular patch is given by the equation:

$$R = K/\sqrt{\left\{ 1 = \frac{2h}{\pi \cdot \epsilon_r \cdot K} \cdot \left[ \log\left(\frac{\pi \cdot K}{2h}\right) + 1.7726 \right] \right\}} \quad (4)$$

where:

$$K = 8.794/(f_r \sqrt{\epsilon_r}) \quad (5)$$

where:

$$K = 8.794/(f_r \sqrt{\epsilon_r}) \quad (5)$$

Any microstrip patch may be used as an element of an array of the following types:

serial, parallel, combination of serial and parallel.

This technology produces antennas (or antenna arrays) that are:

thin, light in weight, of low cost (quick and easy to manufacture), and able to be "conformed" to apply them to, for example, cylindrical and conical structures.

The microstrip antenna is an electronic resonator which is designed to have a high Q. Because of this, antennas using this technology always have a small bandwidth, i.e. resonance occurs in a localized manner only at the frequency for which the antenna is sized and at frequencies very near this frequency.

For example, a conventional rectangular microstrip antenna sized to resonate at 1.6 GHz on a 1 mm thick substrate with dielectric constant $\epsilon r$=2.2 is usable only in a frequency band whose width is in the order of 1% of the resonant frequency, which is insufficient for most applications (telemetry, etc).

Various methods have previously been proposed to overcome this problem.

The simplest way to increase the antenna bandwidth is to make the dielectric layer thicker. This method has the following drawbacks:

small increase in bandwidth;

increased ohmic losses in the substrate;

generation of surface waves, and increased antenna overall size.

The concept most often used is to stack radiating elements that are not fed (with their associated dielectric layer) on the fed element. These elements are called "parasitic elements". Each of these elements i is sized to resonate at a frequency $F_i$ near the frequency $F_a$ of the fed element. Electromagnetic coupling between these elements and the fed elements causes transfer of energy to the "parasitic elements". The overall frequency response is the envelope of the responses of each element.

This so-called multilayer structure and structures derived from it have the following disadvantages:

increased thickness, which may be unacceptable if the antenna is required to be thin, especially if it must be conformed (aerospace applications, launch vehicles);

mechanical inconsistencies and discontinuities affecting the performance of the antenna if it is subject to mechanical or thermal stress (antenna on aircraft, missiles or satellites); and problems in manufacturing the antenna respecting the dimensions and relative positions of the various layers (affecting the radio frequency performance).

Consideration might be given to including a layer of air (an excellent dielectric) between the I and S surfaces. This concept is merely a variant of what is described above and has the same mechanical drawbacks.

There thus remains in some applications the requirement to develop a single layer (i.e. only one dielectric layer) structure broadband antenna which avoids the above drawbacks.

It has already been proposed to place two rectangular parasitic patches along non-radiating sides of a fed rectangular patch, or even four rectangular parasitic patches along sides of this patch, in order to enable strong coupling between the facing sides of these patches. Reference may be had to the document WO-89/07838 or to the article "Non-radiating Edges and Four Edges Gap-Coupled Multiple Resonator Broad Band Microstrip Antennas" by G. KUMAR and K. C. GUPTA published in I.E.E.E. Transactions on Antennas and Propagation, Vol. AP 33 n° 2, February 1985. There are preferably four parasitic patches whose dimensions are at least similar to the central patch.

An array of such antennas is obtained by reproducing periodically along one or even two directions in a plane groups of three (or preferably five) patches of which only one is fed, which raises problems of overall size since between two fed patches there are two parasitic patches separated by a substantial gap; also, the feed is in principle from under the surface carrying the patches (see in particular the document WO-89/07838 which is the only one of the aforementioned two documents to make express provision for producing an array of this kind). The disclosures of these two documents are therefore unable to meet a spacing constraint in the nature of $\Delta<0.5\ \lambda_o$, for example.

British Patent 2,067,842 also discloses the association on a dielectric substrate of at least one parasitic patch near a rectangular patch fed through the substrate, of the same size and grounded; either the fed patch and the single parasitic patch are both grounded via their opposite sides or the fed patch is isolated and surrounded with two or even four parasitic patches coupled to ground by their sides adjacent the fed central patch. The above drawbacks, among others, are encountered.

U.S. Pat. No. 4,933,680 proposes an array whose constituent elements are not simple patches but a plurality of elementary patches ("plural-radiators") resonating at different frequencies (and therefore having different geometries) which may be separated by parasitic patches. These elementary patches are not fed simultaneously. At each operating frequency a set of circulators exploits the mismatching of non-resonant elements to "route" the maximum energy from the feed network to the element resonating at the required operating frequency.

This structure enables operation in a given frequency band with a single-layer structure but has drawbacks which render it unusable in some applications:

- the complexity of the feed network; and
- the large overall size of the "plural-radiators" which is incompatible with severe constraints in respect of the maximal spacing between elements active at a given time usually imposed for controlling the radiation diagram (for example: $\Delta/\lambda_o>0.5$).

An object of the invention is to alleviate the aforementioned drawbacks by virtue of an array antenna (i.e. an antenna formed by a periodic array of elementary patches) combining advantages including:

- compliance with severe spacing constraints ($\Delta/\lambda_o<1$, or even $\Delta/\lambda_o<0.5$) between the phase centers imposed for reasons of small overall size or for better control of the radiation diagram, preferably combined with compact transverse dimensions;
- a greater bandwidth than with patches that are all identical;
- small overall thickness (in particular, thin dielectric);
- feasibility of single-layer (i.e. single layer of dielectric) and multi-layer structures;
- possibility of using a "coplanar" feed network, i.e. a network on the same side of the dielectric as the patches;
- possibility of conforming the antenna; and
- high mechanical strength.

SUMMARY OF THE INVENTION

The invention is an array antenna embodying on a dielectric support, a periodic succession parallel to an alignment direction of rectangular patches having alternating active patches and parasitic patches. The active patches are identical, fed with electromagnetic energy in areas such that their sides parallel to the alignment direction are radiating sides, sized to have the same resonant frequency and disposed so that their phase centers are at a distance apart less than the wavelength in air $\lambda_o$ associated with the resonant frequency. The parasitic patches are separated from the active patches by slots of constant non-null width extending transversely to the alignment direction and sized to have resonant frequencies near the resonant frequency of the active patches.

According to preferred features of the invention, some of which may be combinable;

- the parasitic patches are either of a first type having a first resonant frequency or of a second type having a second resonant frequency whereby the antenna is formed by the repetition of groups of four patches.
- The parasitic patches are of a single type having a common resonant frequency near the resonant frequency of the active patches;
- At least some of the parasitic patches are offset relative to the active patches transversely to the alignment direction.
- The parasitic patches are offset in the same direction.
- The distance $\Delta$ between the phase centers of the active patches is at most in the order of $\lambda_o/2$;
- The active patches are connected in parallel to a feed circuit.
- The width of the slots is at most equal to $\lambda_o/(50.\sqrt{(\lambda_r+1)/2})$ where $\lambda_r$ is the dielectric constant of the dielectric support;
- The constant width slots extend over at least 80% of the transverse dimension of the active patches.

Objects, features and advantages of the invention will emerge from the following description given by way of non-limiting example with reference to the appended drawings.

BRIEF DESCRIPTION OF THE DRAWINGS

FIGS. 3A, 3B and 3C are curves showing the correlation between the frequency and the voltage standing wave ratio (VSWR) of an antenna as shown in FIG. 1 for different lengths of the parasitic patches;

FIGS. 4A and 4B are impedance curves obtained from a SMITH chart before and after optimization;

FIGS. 12A and 12B are the radiation diagrams obtained for the frequency of 2,511 GHz;

DETAILED DESCRIPTION OF THE INVENTION

Figure 1:
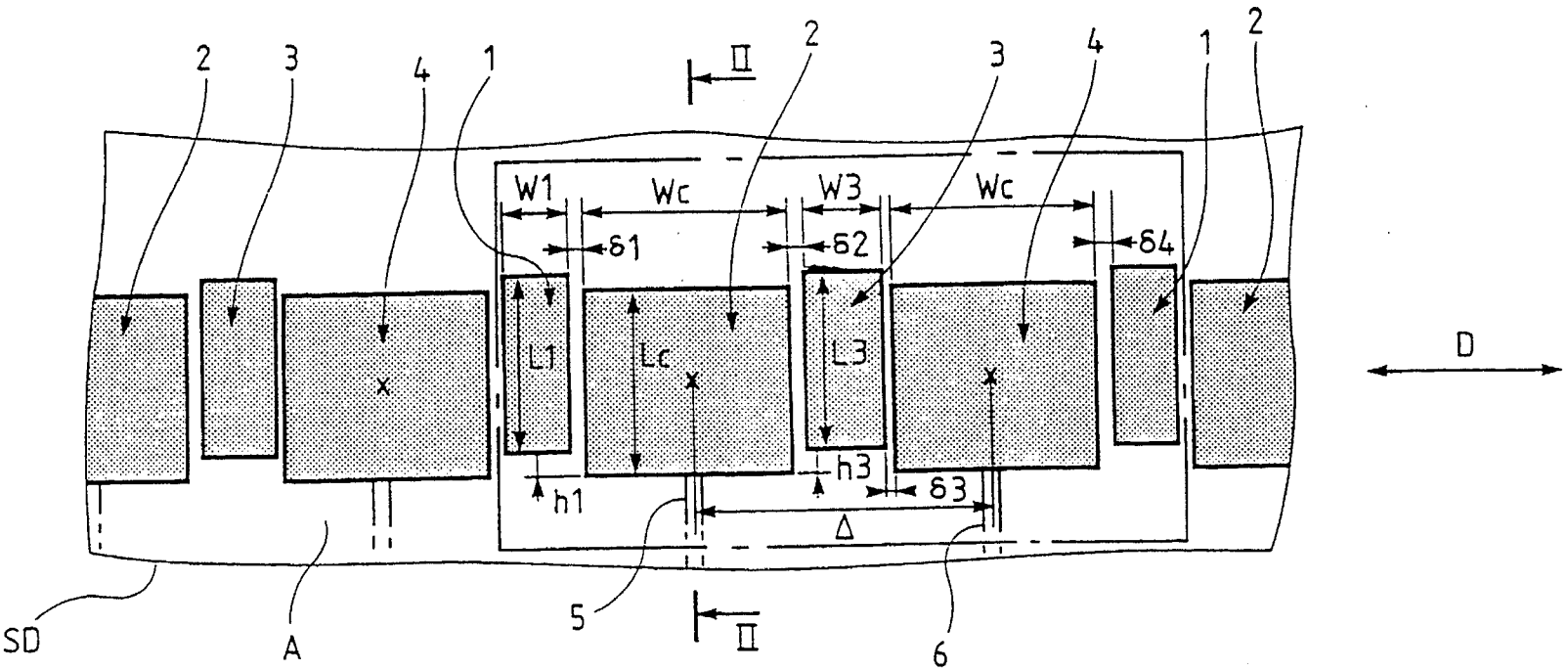
FIG. 1 is a partial plan view of an array antenna in accordance with the invention.

FIG. 1 shows part of an array antenna A formed by a periodic succession parallel to a direction D of rectangular microstrip patches on the upper surface S of a dielectric substrate SD on the inside surface I of which is a ground layer M; this succession has a period of four in this example, i.e. that the array antenna A is formed by repeating a group of four rectangular elementary patches 1, 2, 3 and 4.

The even number patches, i.e. the patches 2 and 4, are identical to within manufacturing tolerances. They are "active" in the sense that they are fed simultaneously, in practice continuously, by a feed circuit (not shown). The connection to this circuit is made in this example by lines 5 and 6 coplanar with the patches 2 and 4. In an alternative embodiment (not shown) this connection is made through the substrate.

The method of connecting the patches to the feed circuit depends on the points at which the patches must be fed, with particular reference to matching and implementation constraints; in particular, these points are such that the sides of these patches parallel to the alignment direction D are radiating sides and the sides transverse to direction D are non-radiating sides (in principle these points are therefore near respective median lines of these rectangles which are perpendicular to direction D). In the example shown lines 5 and 6 feed points located at the middle of the radiating sides.

The crosses aligned with the lines 5 and 6 denote the phase centers. Their spacing A is chosen to conform to the spacing criterion required for the application in question to control the grating lobes (for example: $\Delta/\lambda_o<0.5$). The distance between the feed points is a good approximation of the distance between the phase centers.

The length Lc of these active patches (i.e. their dimension transverse to direction D) is determined from the above equation (1), for example, or by any appropriate form of prior art software, so that the resonant frequency Fc is in the band of frequencies required of the array antenna, approximately at its center, for example. Similarly, the width Wc of the active patches (i.e. their dimension parallel to direction D) is determined from the above equation (3), for example, or by any appropriate form of prior art software, according to requirements for the radiation diagram of the array antenna.

The odd number patches (1 and 3) alternate with these active patches, between their non-radiating edges, and are "parasitic" in the sense that they are not connected to the feed circuit and are each electromagnetically coupled to the two active patches between which they lie via constant width slots. As shown,

- L1, W1, L3, W3 denote the lengths and widths of the parasitic elements,
- δ1, δ2, δ3 and δ4 denote the non-null widths of the slots between the patches 1 and 2, 2 and 3, 3 and 4, and 4 and 1, and
- h1 and h3 denote any offset transverse to direction D of the parasitic patches relative to a base line on which the radiating sides (either the lower or the upper sides) of the active patches are aligned. In FIG. 1 the offsets h1 and h3 are measured relative to the line on which the lower sides of the active patches are aligned, on which (or near which) the feed points are situated. These offsets are sufficiently small relative to the lengths Lc, L1 and L3 (not exceeding 15 to 20% of these lengths, for example) for them to represent no impediment to coupling between the active and parasitic patches.

The condition that the patches must not overlap may be written:

$$\Delta-Wc=W1+\delta1+\delta4=W3+\delta2\delta3 \quad (6)$$

The non-null width of the slots may be represented, for example, by the condition that their width is at least $\lambda_o/(10.000.\sqrt{\epsilon_e})$ where $\lambda_o$ is the wavelength in air or in vacuum associated with the resonant frequency Fc.

Coupling between the parasitic and active patches through the slots sets a maximum value for the width of the latter (for example $\lambda_o/50\times\sqrt{\epsilon_e}$) although a parasitic patch is not necessarily equally strongly coupled to each of the adjoining active patches. For example, a slot whose width is less than $\lambda_o/500\times\sqrt{\epsilon_e}$) procures "strong" coupling, in excess of −10 dB, i.e. the parasitic patch "benefits" from at least 20% of the energy of the active patches. The parasitic patches are sized and positioned so that their resonant frequencies F1 and F3 are:

- sufficiently near Fc to obtain an overall response having a voltage standing wave ratio (or other like parameter) below the value set by the antenna specifications (typically 2, even 1.5), but
- sufficiently far from Fc to have the greatest possible response bandwidth.

The frequencies F1 and F3 may be the same.

Sizing is advantageously determined by an iterative method following an a priori choice of frequencies F1 and F3 and various other parameters.

The start conditions may be as follows, for example:

$$h1=h3=0 \quad (7)ps$$

$$\delta1=\delta2=\delta3=\delta4=\delta=\lambda_o/(100\times\sqrt{\epsilon_e}) \quad (8)$$

$$W1=W2=\Delta-Wc-2\delta \quad (9)$$

and the lengths L1 and L3 to obtain F1 and F3 are determined from equation (1), for example.

An antenna constructed with these dimensions has a frequency response that can be represented in various ways.

FIGS. 3A, 3B and 3C are representations (VSWR vs frequency) in which the thicker line curve shows the overall response and the thinner line curves show the individual response of each patch.

FIG. 3A represents the case in which the response VSWR is very close to 1 throughout the frequency band between F1 and F3. This is an ideal case, provided that the bandwidth is sufficient in the light of the specifications, which is rare in practice. This type of curve usually means that it is possible to increase the bandwidth further without prejudice to the target VSWR (1.5 or 2).

FIG. 3B shows a satisfactory case when the target VSWR is 2× over the frequency band in question, which is wider than that of FIG. 3A, the observed VSWR remains below 2 although it approaches this value at some frequencies in the band. There is scope for further optimization if it is required to increase the bandwidth further.

FIG. 3C shows a case where the VSWR exceeds the threshold: further optimization is required, or the bandwidth may even have to be reduced.

It is more usual to represent the response of the antenna in the form of an impedance curve plotted on a SMITH chart. FIG. 4 shows one example of this: each loop of the curve represents a resonance and the part of the curve contained within a circle defined by the maximum authorized VSWR (in this example VSWR=2) determines the frequency band in which the antenna meets the specifications (in other words, this is the tuned frequency excursion for which the antenna can be used).

Optimization involves maximizing this frequency band. This is done iteratively by operating on several parameters in succession:

1—the dimensions δ1, δ2, δ3, δ4 for modifying the size and shape of the elementary loops;

2—the offsets h1 and h3 for modulating the size and the shape of the loops and also the general shape of the impedance curve; and 3—the width of the feed line on the surface or on a lower layer (microstrip drive), and the entire feed array for centering the curve on the SMITH chart by translatory movement.

In practice these various factors are not totally independent and this is why the sequence 1, 2, 3, etc. must be repeated until conformance with the specification is achieved (see FIG. 4B, for example, where the three loops are in the circle VSWR=2).

It will be realized that the invention has this advantage in particular over the cited prior art (in particular patent n° WO-89/07838 or the article in I.E.E.E. Trans. on A.P., Vol. AP33, February 1985) that it makes it possible to comply with a severe active patch spacing constraint (in this context severe means: spacing between phase centers less than wavelength λ). It is still applicable in less severe cases, however, provided that the width of the parasitic patches does not significantly exceed Wc.

Figure 2:
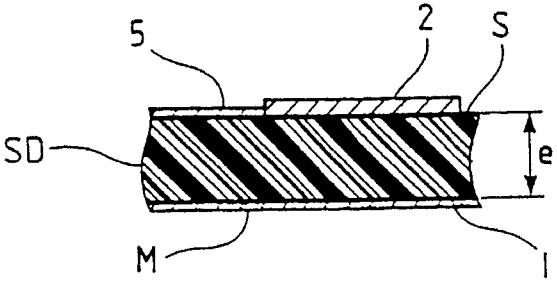
FIG. 2 is a view of an active element of the array antenna from FIG. 1 in crosssection taken on the line II—II in FIG. 1.

If the frequency response is denoted $R(F_r)$ it may be expressed as follows:

$$R(F_r)=f(L1, L3, W1, W3, \delta 1, \oplus 2, \delta 3, \delta 4, h1, h2, Lc, Wc, e, \epsilon_r)$$

where:

e is the thickness of the dielectric support (see FIG. 2), and $\delta_r$ is the dielectric constant of the dielectric.

This function is not a simple one to express but software modelling of the function is feasible.

Figure 5:
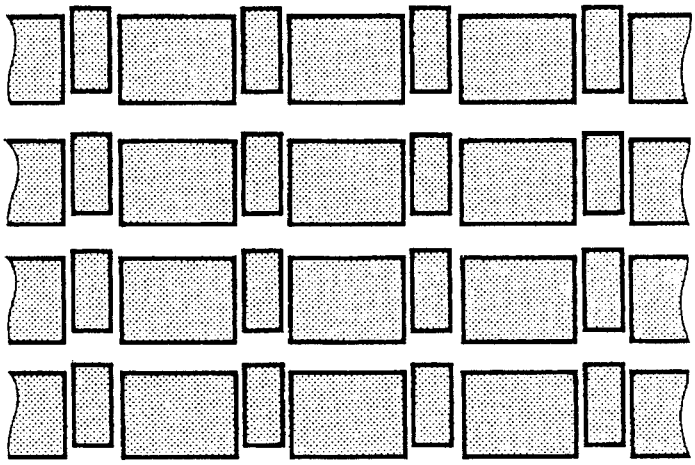
FIG. 5 is a plan view of a two-dimensional array antenna in accordance with the invention.

The array shown here is linear (i.e. one-dimensional) but with an appropriate feed system it can be extended to form a two-dimensional array as shown in FIG. 5.

For example, an attempt has been made to implement an array antenna as shown in FIG. 1 to operate in the S band (around 2 300 MHz) with a 2.28 mm thick dielectric having a dielectric constant $\delta_r$=2.6 (a glass-PTFE type dielectric marketed by the company TACONIC under the tradename TLX).

The underlying plane forming the ground plane and the patches were 35 μm thick copper.

The target VSWR was 2.

The optimization process yielded the following dimensions:

Lc=42 mm
Wc=50 mm
L1=41 mm
L3=44 mm
W1=18.4 mm
W3=18 mm
δ1=1.4 mm
δ2=2.3 mm
δ3=1.6 mm
δ4=1.6 mm
h1=4.5 mm
h3=2 mm

Figure 6A:
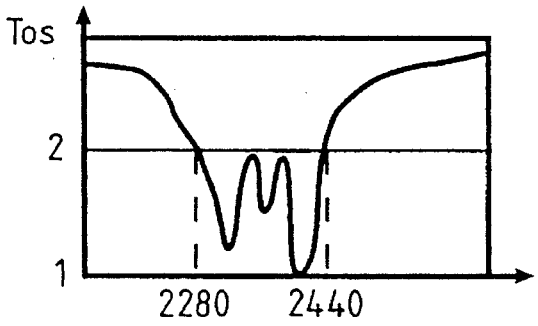
FIGS. 6A and 6B show the response obtained for a prototype conforming to FIG. 1 using the same form of representation as FIGS. 3A through 3C and 4A and 4B.
Figure 6B:
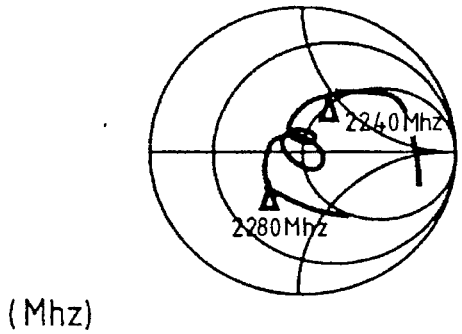

A prototype was constructed according to FIG. 1 with three patches 4, 2, 4 fed simultaneously by lines of the same impedance and two end patches (only part of which is shown) identical to the other patches but not fed (to simulate the remainder of the array to the right and to the left). The prototype was tested and its response is shown in FIGS. 6A and 6B using the two types of representation of FIGS. 3A through 3C and 4A and 4B, respectively. Note that the VSWR remains below 2 over a bandwidth of around 7%. Further iteration could no doubt increase the bandwidth further, to around 10%.

Note that the parasitic patches 1 and 3 are different sizes, corresponding to three resonant frequencies (see the three peaks in FIG. 6A or the three loops in FIG. 6B). Also, the spacings δ1, δ2, δ3, δ4 are different and the heights h1 and h3 are non-null.

Figure 7:
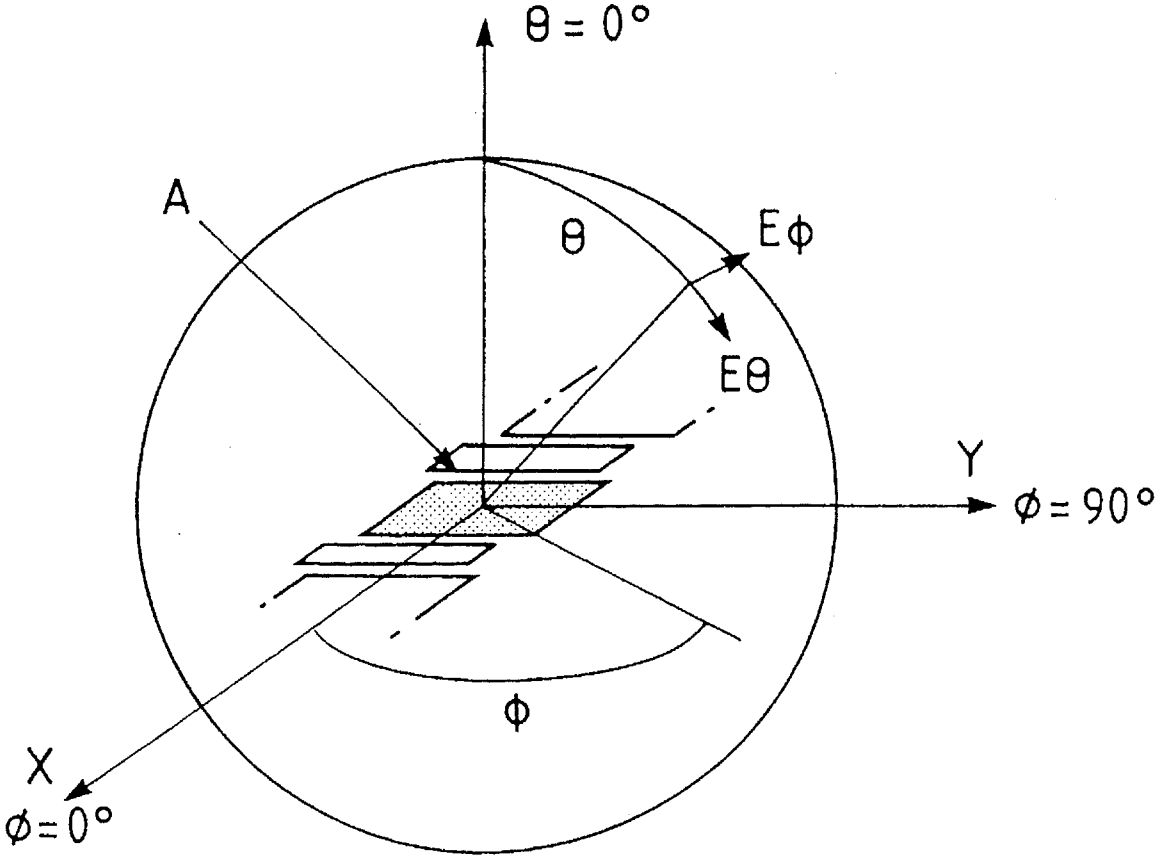
FIG. 7 shows the frame of reference associated with the antenna and with respect to which the radiation diagram measurements are defined.
Figure 8B:
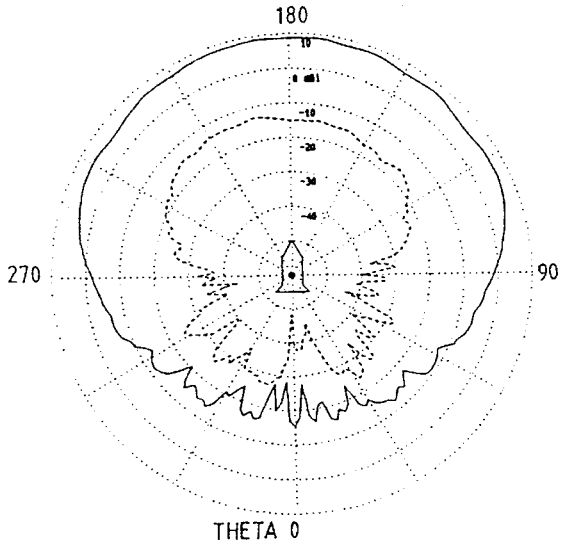
FIGS. 8A and 8B are radiation diagrams obtained for the antenna from FIG. 1 at the frequency of 2,167 GHz in the $\emptyset=0$ and $\emptyset=90°$ crosssection.
Figure 8A:
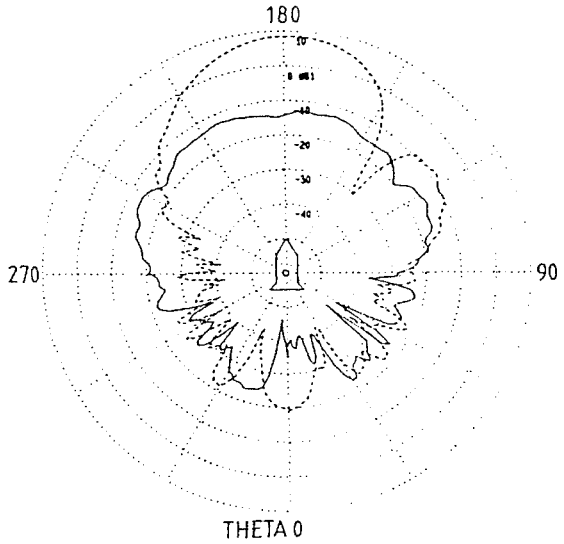
Figure 9B:
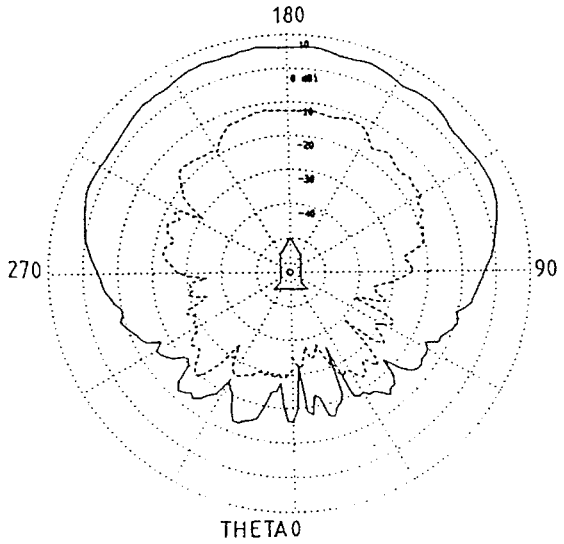
FIGS. 9A and 9B are the radiation diagrams obtained for the frequency of 2,220 GHz.
Figure 9A:
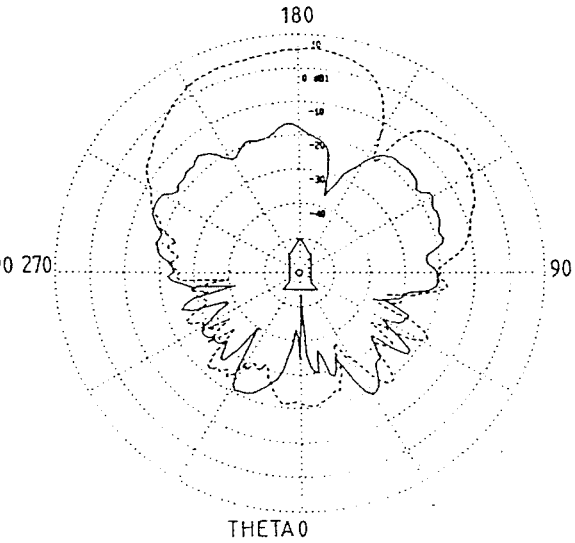
Figure 10B:
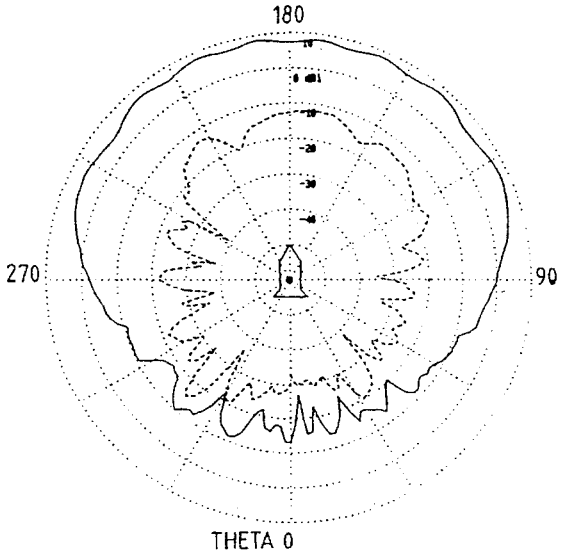
FIGS. 10A and 10B are the radiation diagrams obtained for the frequency of 2,332 GHz.
Figure 10A:
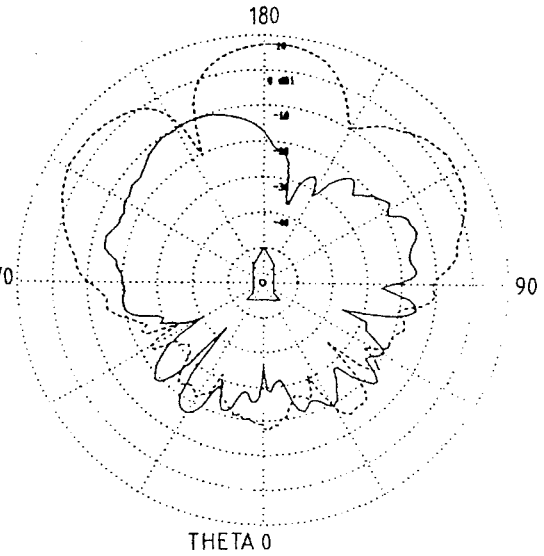
Figure 11B:
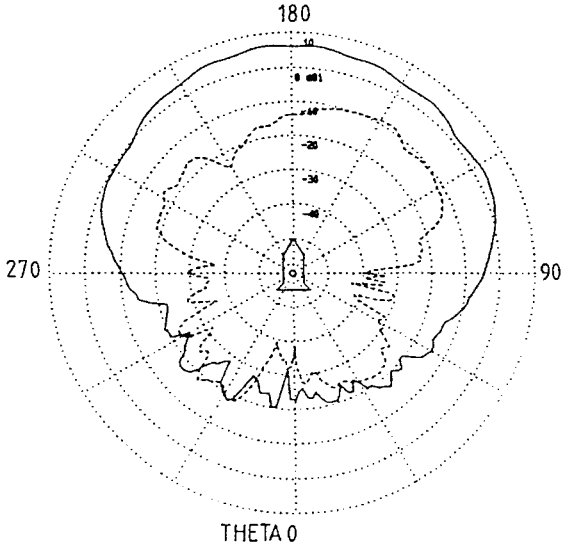
FIGS. 11A and 11B are the radiation diagrams obtained for the frequency of 2,400 GHz.
Figure 11A:
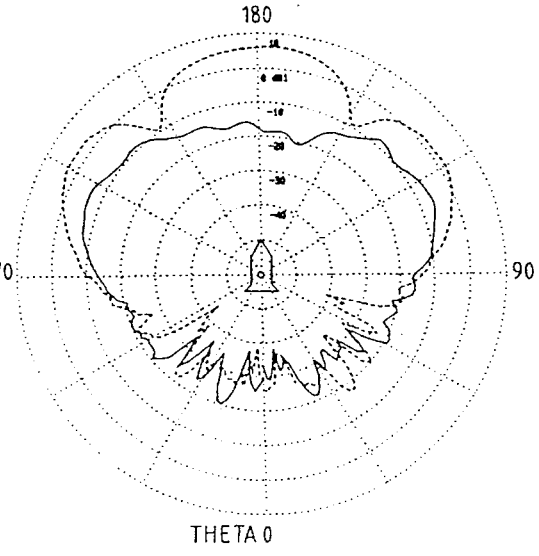

The radiation diagram of the above antenna was measured in the measurement frame of reference shown in FIG. 7 at five frequencies not only in the potentially usable bandwidth (FIGS. 10A, 10B, 11A and 11B) but also near this bandwidth (FIGS. 8A, 8B, 9A, 9B, 12A and 12B) where the antenna is no longer matched but continues to radiate.

FIGS. 8A through 12B give the ϕ=0° and ϕ=90° cross-sections. The ϕ=0° crosssection represents a plane perpendicular to the plane of the array and parallel to the largest dimension of the array.

Note that the diagram is stable in the matching band, and the diagram is distorted to either side of this frequency band. The maximum gain direction is retained but the shape, the directions and the level of the side lobes vary in planes where the grating effect is observable (i.e. ϕ≠90°).

The antenna is therefore usable outside its matched band, subject to distortion in its radiation diagram.

Note that this antenna in accordance with the invention meets the stated objective because it conforms to a low VSWR over a broad band of frequencies without requiring a thick dielectric support or penalizing conventional performance.

Note further that the spacing Δ between the phase centers, which is in the order of 72 mm, is around half the wavelength (around 130 mm) at the target frequency.

Note further that this array antenna conforms to the objective of having compact transverse dimensions given the low values of h1 and h3 relative to Lc (less than 15% in this example) and the fact that the lengths L1 and L3 do not significantly exceed the length Lc. Moreover the fact that L1 and L3 are not significantly less than Lc promotes good capacitative coupling. L1 and L3 are preferably equal to Lc to within around 10%.

To give an application example, an array antenna in accordance with the invention is constructed in the form of a belt adapted to be carried by the surface of a cylindrical body which is part of a spacecraft, for example. The number of elements to be distributed over the cylinder is determined by a calculation to optimize the radiation diagram (homogeneous spatial distribution of energy and phase). This calculation yields the array element spacing constraint for a given circumference of the cylindrical structure and for a given feed system.

In an elementary version the invention proposes the antenna contained within the box in FIG. 1, i.e. a succession of at least two identical active patches 2 and 4 between which is a parasitic patch 3 of one type and which are between two parasitic patches 1 of a second type, so forming a series 1 2 3 2 1 (allowing for the fact that patches 2 and 4 are identical).

More generally, the antenna is of the 1 2 3 2 1 2 3 . . . 3 2 1 type (or 3 2 1 2 3 . . . 1 2 3 type, respectively), with the 1 2 3 2 group repeating.

It goes without saying that the foregoing description has been given by way of non-limiting example only and that numerous variants may suggest themselves to one having ordinary skill in the art without departing from the scope of the invention. Specifically, although FIG. 1 shows two different type parasitic patches and although it is stated above that there may be only one type parasitic patch, it is evident that any number of parasitic patch types may be used respective to the same number of frequencies in the target frequency band. Also, the active elements may be fed with electromagnetic energy by electromagnetic coupling to an underlying feed network separated by dielectric layers from the ground plane and from the radiating patches; a multilayer solution like this meets the objectives of the invention also provided that the cumulative thicknesses of the dielectric layers are compatible with what is required.

There is claimed:

1. An array antenna comprising:

a dielectric support; and a plurality of rectangular microstrip patches successively arranged on said dielectric support parallel to an alignment direction, wherein said plurality of rectangular microstrip patches establishes a periodic succession including more than a single period, each said period including more than one rectangular microstrip patch of said plurality of rectangular microstrip patches, and comprises:

a plurality of parasitic patches and a plurality of active patches disposed on said dielectric support in a parasitic patch/active patch alternating arrangement where each of said plurality of active patches is separated by one of said plurality of parasitic patches and each of said plurality of parasitic patches is separated by one of said active patches, each of said plurality of active patches are identically dimensioned to have substantially the same resonant frequency, each of said plurality of active patches further being disposed on said dielectric support so that respective phase centers of consecutive ones of said active patches in each said period are separated by a distance less than a wavelength in air $\lambda_o$ associated with the resonant frequency, each of said plurality of active patches further being fed with electromagnetic energy to produce radiating sides parallel to said alignment direction, each of said plurality of parasitic patches having respective resonant frequencies near the resonant frequency of said plurality of active patches, each of said plurality of parasitic patches further being disposed on said dielectric support to be separated from adjacent active patches by a slot of constant non-null width extending transversely to said alignment direction, and each parasitic patch of said plurality of parasitic patches is necessarily electromagnetically coupled to two active patches of said plurality of active patches.

2. The array antenna according to claim 1 wherein said plurality of parasitic patches comprises a first type having a first resonant frequency and a second type having a second resonant frequency, wherein each said period consists of four microstrip patches.

3. The array antenna according to claim 2 wherein said first type of said plurality of parasitic patches are disposed on said dielectric support offset a first distance relative to said plurality of active patches in a direction transverse to said alignment direction and said second type of said plurality of parasitic patches are disposed on said dielectric support offset a second distance relative to said plurality of active patches in a direction transverse to said alignment direction.

4. The array antenna according to claim 3 wherein said first type and said second type of said plurality of parasitic patches are offset in the same direction transverse to said alignment direction.

5. The array antenna according to claim 1 wherein said plurality of parasitic patches are of a single type having a common resonant frequency near the resonant frequency of said plurality of active patches.

6. The array antenna according to claim 1 wherein at least one parasitic patch of said plurality of parasitic patches is disposed of said dielectric support and offset relative to said plurality of active patches in a direction transverse to said alignment direction.

7. The array antenna according to claim 6 wherein said plurality of parasitic patches are offset in the same transverse direction.

8. The array antenna according to claim 1 wherein the distance between said phase centers of said active patches is less than approximately $\lambda_o/2$.

9. The array antenna according to claim 1 wherein said plurality of active patches are connected in parallel to a feed circuit.

10. The array antenna according to claim 1 wherein said plurality of active patches are connected in series to a feed circuit.

11. The array antenna according to claim 1 wherein the non-null width slots is no greater than approximately $$\frac{\lambda_0}{50\sqrt{(\epsilon_r+1)/2}},$$

where $\epsilon_r$ is the dielectric constant of each dielectric support.

12. The array antenna according to claim 11 wherein said non-null width of each of said slots is equal.

13. The array antenna according to claim 11 wherein said non-null width of each of said slots is different to define a desired bandwidth of said array antenna.

14. The array antenna according to claim 1 wherein said constant non-null width slots extend over at least 80% of a transverse dimension of each of said plurality of active patches, said transverse dimension extending transversely to said alignment direction.

15. The array antenna according to claim 1 wherein said plurality of parasitic patches are disposed on said dielectric support offset relative to said plurality of active patches in a direction transverse to the alignment direction.

16. An array antenna comprising:

a dielectric support; and a plurality of rectangular microstrip patches successively arranged on said dielectric support parallel to an alignment direction, wherein said plurality of rectangular microstrip patches establishes a periodic succession including more than a single period, each said period including more than one rectangular microstrip patch of said plurality of rectangular microstrip patches, and comprises:

a plurality of parasitic patches and a plurality of active patches disposed on said dielectric support in a parasitic patch/active patch alternating arrangement where each of said plurality active patches is separated by one of said plurality of parasitic patches and each of said plurality of parasitic patches is separated by one of said active patches, each parasitic patch of said plurality of parasitic patches is necessarily electromagnetically coupled to two active patches of said plurality of active patches, said two active patches being the nearest of said plurality of active patches to each said parasitic patch, each of said plurality of active patches are identically dimensioned and have substantially the same resonant frequency, each of said plurality of active patches further being disposed on said dielectric support so that respective phase centers of consecutive ones of said active patches in each said period are separated by a distance less than a wavelength in air $\lambda_o$ associated with the resonant frequency, each of said plurality of active patches further being fed with electromagnetic energy to produce radiating sides parallel to said alignment direction, said plurality of parasitic patches comprising a first type having a first resonant frequency near the resonant frequency of said plurality of active patches and a second type having a second resonant frequency, wherein each said period includes four microstrip patches, each of said plurality of parasitic patches further being disposed on said dielectric support to be separated from adjacent active patches by a slot of constant non-null width extending transversely to said alignment direction; whereby said first type of said plurality of parasitic patches are disposed on said dielectric support offset relative to said plurality of active patches in a direction transverse to said alignment direction by a first distance and said second type of said plurality of parasitic patches are disposed on said dielectric support offset relative to said plurality of active patches in a direction transverse to said alignment direction by a second distance.

17. An array antenna comprising:

a dielectric support; and a plurality of rectangular microstrip patches successively arranged on said dielectric support parallel to an alignment direction, wherein said plurality of rectangular microstrip patches establishes a periodic succession including more than a single period, each said period including more than one rectangular microstrip patch of said plurality of rectangular microstrip patches, and comprises:

a plurality of parasitic patches and a plurality of active patches disposed on said dielectric support in a parasitic patch/active patch alternating arrangement where each of said plurality of active patches is separated by one of said plurality of parasitic patches and each of said plurality of parasitic patches is separated by one of said active patches, each parasitic patch of said plurality of parasitic patches is necessarily electromagnetically coupled to two active patches of said plurality of active patches, said two active patches being the nearest of said plurality of active patches to each said parasitic patch, each of said plurality of active patches are identically dimensioned and have substantially the same resonant frequency, each of said plurality of active patches further being disposed on said dielectric support so that respective phase centers of consecutive ones of said active patches in each said period are separated by a distance less than a wavelength in air $\lambda_o$ associated with the resonant frequency, each of said plurality of active patches further being fed with electromagnetic energy to produce radiating sides parallel to said alignment direction, said plurality of parasitic patches comprising a first type having a first resonant frequency near the resonant frequency of said plurality of active patches and a second type having a second resonant frequency, wherein each said period has four microstrip patches, each of said plurality of parasitic patches further being disposed on said dielectric support to be separated from adjacent active patches by a set of slots of constant non-null width extending transversely to said alignment direction; said non-null width of each of said set of slots being different depending on a desired bandwidth of said array antenna; whereby said first type of said plurality of parasitic patches are disposed on said dielectric support offset relative to said plurality of active patches in a direction transverse to said alignment direction by a first distance and said second type of said plurality of parasitic patches are disposed on said dielectric support offset relative to said plurality of active patches in a direction transverse to said alignment direction by a second distance.

18. The array antenna according to claim 16 wherein the distance between said phase centers of said active patches is less than approximately $\lambda_o 2$.

19. The array antenna according to claim 17 wherein the distance between said phase centers of said active patches is less than approximately $\lambda_o 2$.

20. The array antenna according to claim 16 wherein said plurality of active patches are connected in series to a feed circuit.

21. The array antenna according to claim 17 wherein said plurality of active patches are connected in series to a feed circuit.

* * * * *

UNITED STATES PATENT AND TRADEMARK OFFICE

CERTIFICATE OF CORRECTION

PATENT NO. : 5,576,718

DATED : November 19, 1996

INVENTOR(S) : Buralli et al

It is certified that error appears in the above-identified patent and that said Letters Patent is hereby corrected as shown below:

Column 4, beginning on line 5, delete "where:" and the equation that follows.

Column 4, line 44, delete "," insert ---- ; ----.

Column 6, line 18, after "embodying" insert ---- , ----.

Column 6, line 33, delete";" insert ---- , ----.

Column 6, line 34, delete "paragraph indentation".

Column 6, line 40, delete ";" insert ---- . ----.

Column 6, line 46, delete ";" insert ---- . ----.

Column 6, line 51, delete "$\lambda_r$" both occurrences, insert ---- $\varepsilon_r$ ----.

Column 6, line 52, delete ";" insert ---- . ----.

Column 6, line 66, delete "crosssection" insert ---- cross section ----.

Column 7, line 18, delete "$\theta$" both occurrences, insert ---- $\phi$ ----; same line delete "crosssection" insert ---- cross section ----.

UNITED STATES PATENT AND TRADEMARK OFFICE

CERTIFICATE OF CORRECTION

PATENT NO. : 5,576,718
DATED : November 19, 1996
INVENTOR(S) : Buralli et al

It is certified that error appears in the above-identified patent and that said Letters Patent is hereby corrected as shown below:

Column 7, line 23, delete "." insert ---- ; ----.

Column 7, line 25, after ";" insert ---- and ----.

Column 7, line 27, delete ";" insert ---- . ----.

Column 7, line 59, delete "A" insert ---- Δ ----.

Column 8, line 33, delete "Δ-Wc=W1+δ1+δ4=W3+δ2δ3" insert

---- Δ-Wc=W1+δ1+δ4=W3+δ2+δ3 ----.

Column 9, line 60, delete "⊕2" insert ---- δ2 ----.

Column 9, line 65, delete "δ" insert ---- ε ----.

Column 10, line 7, delete "δ" insert ---- ε ----.

Column 10, line 49, delete "cross-" insert ---- cross ----.

Column 10, line 50, delete "crosssection" insert ---- cross section ----.

Column 12, line 41, delete "of" insert ---- on ----.

UNITED STATES PATENT AND TRADEMARK OFFICE

CERTIFICATE OF CORRECTION

PATENT NO. : 5,576,718
DATED : November 19, 1996
INVENTOR(S) : Buralli et al

It is certified that error appears in the above-identified patent and that said Letters Patent is hereby corrected as shown below:

Column 13, line 21, insert paragraph indentation to reflect subelement.

Column 14, line 53, delete "$\lambda_o 2$" insert ---- $\lambda_o/2$ ----.

Column 14, line 56, delete "$\lambda_o 2$" insert ---- $\lambda_o/2$ ----.

Signed and Sealed this

Tenth Day of March, 1998

*Attest:*

*Attesting Officer*

BRUCE LEHMAN

*Commissioner of Patents and Trademarks*